United States Patent [19]

Nishihama et al.

[11] Patent Number: 4,533,618

[45] Date of Patent: Aug. 6, 1985

[54] METHOD FOR TRANSFERRING TONER IMAGE

[75] Inventors: Hitoshi Nishihama, Hirakata; Katsuhiko Gotoda, Osaka; Minoru Motomura, Nara; Tadanobu Nakajima, Sakurai; Tatsuo Aizawa, Osaka, all of Japan

[73] Assignee: Mita Industrial Company, Ltd., Osaka, Japan

[21] Appl. No.: 136,164

[22] Filed: Mar. 31, 1980

Related U.S. Application Data

[63] Continuation of Ser. No. 922,750, Jul. 7, 1978, abandoned, which is a continuation-in-part of Ser. No. 656,195, Feb. 6, 1976, abandoned, which is a continuation-in-part of Ser. No. 599,953, Jul. 29, 1975, Pat. No. 4,081,571.

[30] Foreign Application Priority Data

Aug. 1, 1974 [JP] Japan ..... 49-88381
Jan. 29, 1976 [JP] Japan ..... 51-7917

[51] Int. Cl.[3] ..... G03G 13/16

[52] U.S. Cl. ..... 430/126; 430/111; 355/3 TR

[58] Field of Search ..... 430/122, 126, 903; 427/24; 250/324, 325, 326; 355/3 TR

[56] References Cited

U.S. PATENT DOCUMENTS

| | | | |
|---|---|---|---|
| 2,868,989 | 1/1959 | Haacke | 430/122 |
| 3,399,611 | 9/1968 | Lusher | 430/44 |
| 3,794,839 | 2/1974 | Hayne | 361/320 |
| 3,850,519 | 11/1974 | Weikel | 355/3 TR |
| 3,909,258 | 9/1975 | Kotz | 430/122 |
| 4,199,356 | 4/1980 | Matsumoto | 430/126 |

OTHER PUBLICATIONS

Schaffert, "Electrophotography", Focal Press, 1975, p. 468.

*Primary Examiner*—John Goodrow
*Attorney, Agent, or Firm*—Sherman & Shalloway

[57] ABSTRACT

A method for transferring a toner image on the surface of an image-bearing member obtained as a result of development with a conductive or semi-conductive toner material to the surface of a receptor member, which comprises bringing the surface of the receptor member into contact with the toner image on the surface of the image-bearing member and simultaneously applying a corona discharge to the back surface of the receptor member. The angle formed between the lines of electric force of the corona discharge and a line perpendicular to the receptor member does not exceed about 30 degrees.

10 Claims, 14 Drawing Figures

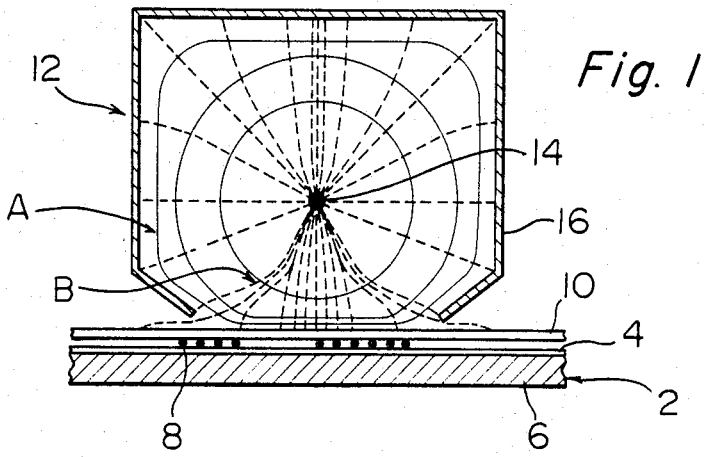
Fig. 1-a
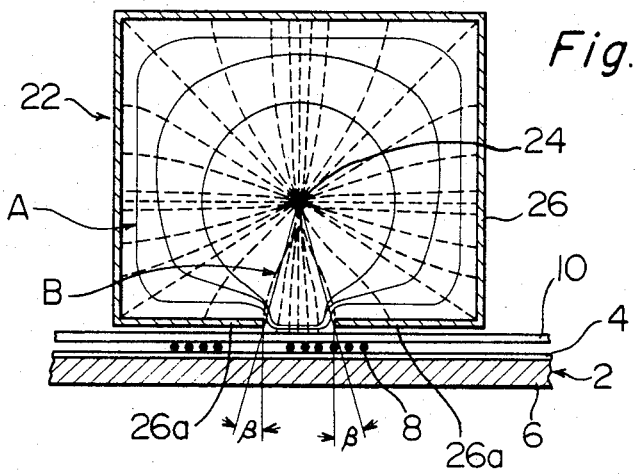
Fig. 2-a
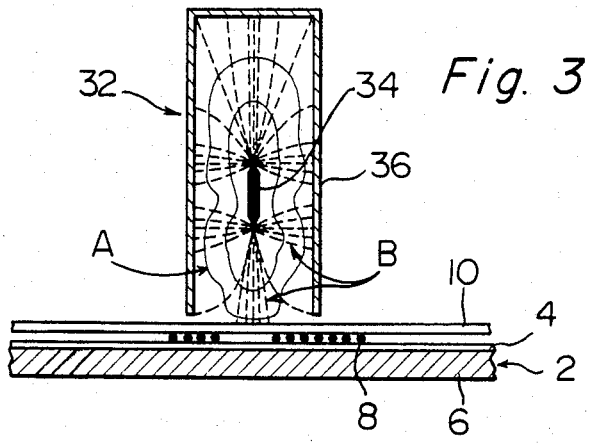
Fig. 3-a

Fig. 1-b
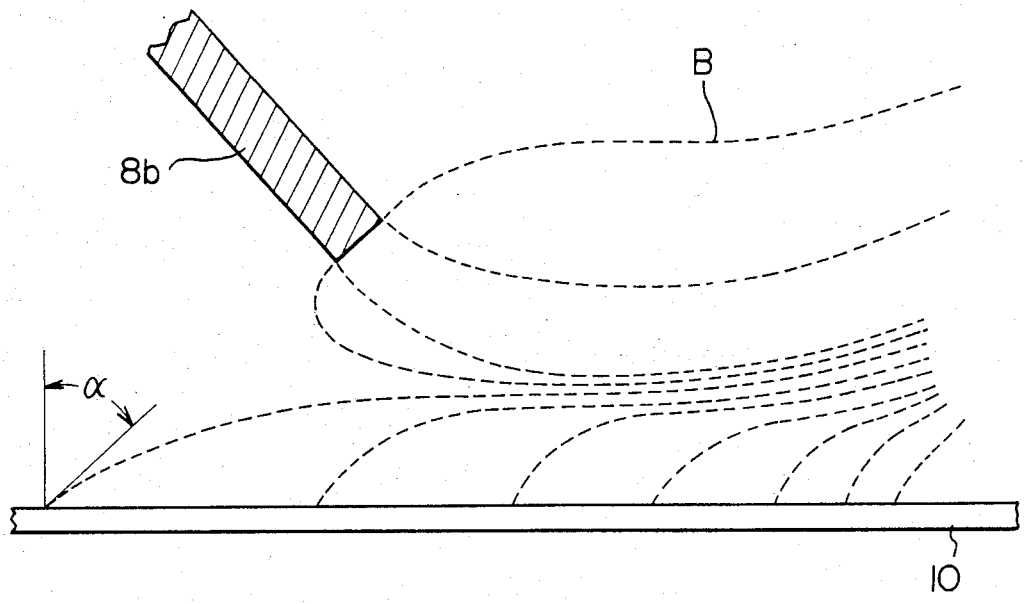
Fig. 2-b
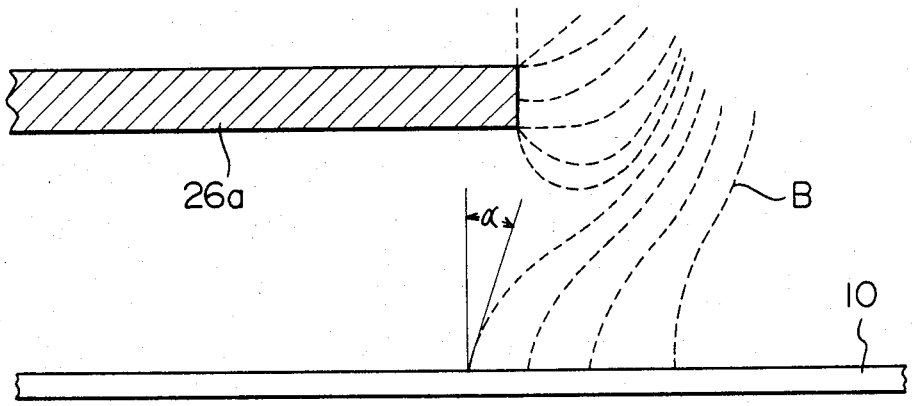

Fig. 3-b
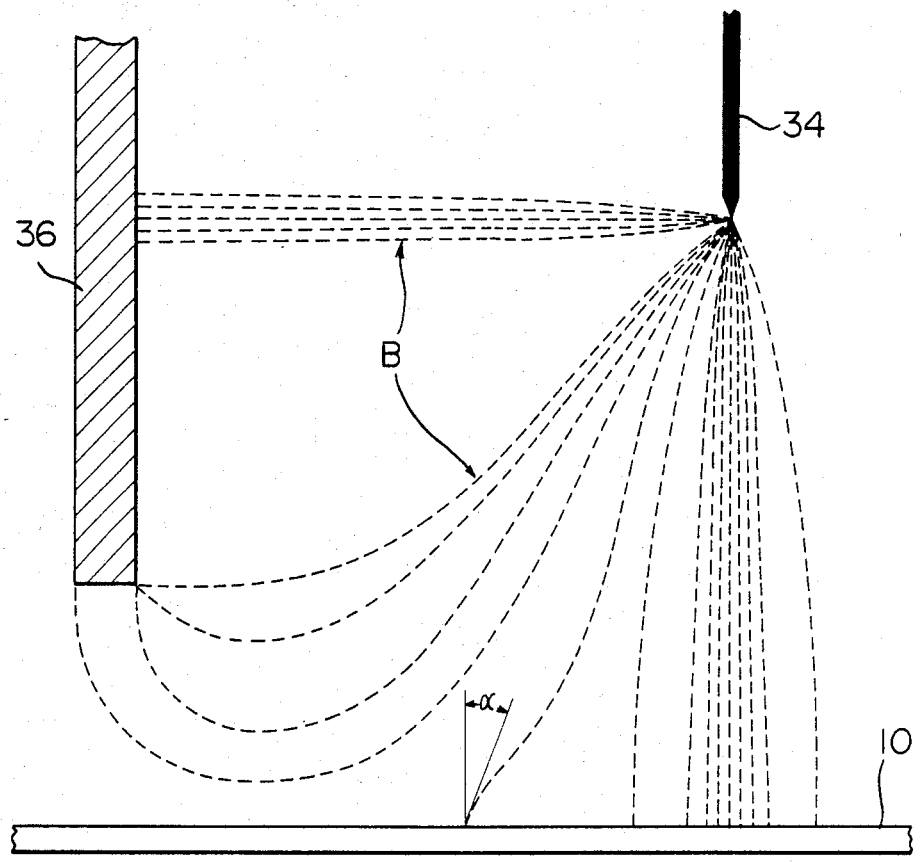

DENSITY
1.0
0.5
0
1.0 0.5 0 0.5 1.0 (mm)
CENTER POSITION

METHOD FOR TRANSFERRING TONER IMAGE

This is a continuation of application Ser. No. 922,750, filed July 7, 1978, now abandoned, which is a continuation-in-part of application Ser. No. 656,195, filed Feb. 6, 1976, now abandoned, which is a continuation-in-part of application Ser. No. 599,953 filed July 29, 1975, now U.S. Pat. No. 4,081,571 and priority is claimed therefrom.

The present invention relates to a method for transferring a toner image on the surface of an image-bearing member to the surface of a receptor member, and more specifically, to a method for transferring a toner image on the surface of an image-bearing member obtained as a result of development with a conductive or semiconductive toner material to the surface of a receptor member.

It is the general practice in electrostatographic processes and electrostatic printing processes to form an electrostatic latent image on an imaging member composed of a photosensitive material having a photoconductive layer, develop the electrostatic latent image with a toner material to form a toner image, and then transfer the toner image to the surface of a suitable receptor member such as paper.

In these processes, the electrostatic latent image is developed with a two-component developer composed of a magnetic carrier and a non-conductive toner material, thereby to form a toner image developed with the non-conductive toner material. Transfer of the toner image to the surface of a receptor member is conveniently carried out by a so-called corona transfer method whereby the surface of the imaging member having the toner image formed on it is contacted with the surface of the receptor member, and a corona discharge is applied to the back surface of the receptor member by a corona discharge device.

In recent years, improved methods of development have been suggested and come into commercial acceptance. They involve the use of a one-component developer consisting only of a conductive or semiconductive toner material instead of the two-component developer. Such a method is disclosed, for example, in U.S. Pat. No. 3,166,432. As is well known to those skilled in the art, development with a one-component developer can be performed well and stably over long periods of time by using a relatively simple device. This type of developing method, however, has serious problems to be solved at the time of transferring the toner image to the receptor surface, which problems are ascribable to the fact that the toner image has been obtained by development with a conductive or semiconductive material. Specifically, when the conventional corona transfer method used for transferring a toner image developed with a non-conductive toner material is directly applied to the transfer of the toner image developed with a conductive or semiconductive toner material, the toner material scatters off considerably during transfer, and the transfer image is unsatisfactory with the contour of letters, figures or the like being blurred.

U.S. Pat. No. 3,123,483 discloses an attempt wherein a magnetically attractable toner is used as the conductive or semiconductive toner material and it is transferred by utilizing a magnetic force. However, this method has the defect that a strong magnetic device is required in order to generate a magnetic force that will overcome an electrostatically attracting force between the toner material and the charge forming the electrostatic latent image. Our investigations demonstrate that the transfer is practically impossible when the magnetic force is of such a degree as used for retaining the developer on the surface of a developer-retaining member. French Pat. No. 2,176,143 discloses an attempt of applying a voltage directly to the back surface of a receptor material by means of, for example, conductive rollers in an electrostatic transferring process. According to this method, the blurring of letters or the like can be removed, but when the receptor material does not exist between the rollers for applying a transferring voltage and an image-bearing member, spark is generated between the image-bearing member and the transfer rollers and both will be destroyed unless this applied voltage is removed. Accordingly, a control device for the application of voltage is required which completely synchronizes with the presence or absence of the receptor material. Furthermore, the toner adheres to the transfer rolls, and since the transfer rolls soiled by the toner are used to push the back surface of the receptor member, the back surface of the receptor member is also soiled. Furthermore, when for example, the toner is one which will allow the transferred image to be fixed to the surface of the receptor material by pressure, the toner is fixed to the image-bearing member by the pressing of the transfer rollers during transfer, and the image-bearing member becomes useless.

A primary object of this invention is to provide a method for transferring a toner image developed with a conductive or semiconductive toner material to a receptor material in good condition.

As a result of extensive investigations and experiments, the present inventors have found that the scattering of toner material which occurs when a toner image developed with a conductive or semiconductive toner material is transferred to a receptor member by the ordinary corona transfer method is due primarily to the fact that the lines of electric force of corona discharge applied to the back surface of the receptor member from a corona discharge device are not perpendicular, but considerably inclined, to the receptor member. The present inventors specifically discovered that when the lines of electric force of corona discharge which are considerably inclined to the receptor member act on the toner material to be transferred from the image-bearing member to the surface of the receptor member, it causes the toner material to scatter in the direction of the lines of electric force between the surface of the image-bearing member and the surface of the receptor member.

Based on the recognition of this fact, the present inventors have found that by maintaining the lines of electric force of the corona discharge applied to the back surface of the receptor member during transfer as perpendicular as possible with respect to the receptor member, and in any case, by keeping the lines of electric force from being inclined by more than about 30 degrees, especially by more than 20 degrees, with respect to a line perpendicular to the receptor member, the scattering of the toner material during transfer can be prevented, and a good quality transfer image having a sharp contour of letters or the like can be obtained on the surface of the receptor member.

According to this invention, there is provided a method for transferring a toner image on the surface of an image-bearing member obtained as a result of development with a conductive or semiconductive toner material to the surface of a receptor member, which comprises bringing the surface of the receptor member into contact with the toner image on the surface of the image-bearing member and simultaneously applying a corona discharge to the back surface of the receptor member; wherein the angle formed between the lines of electric force of the corona discharge and a line perpendicular to the receptor member does not exceed about 30 degrees.

The above and other objects of this invention along with its advantages will become apparent from the following description taken in conjunction with the accompanying drawings in which:

FIG. 1-*a* is a schematic view of the conventional corona transfer method;

FIG. 1-*b* is an enlarged view of a part of FIG. 1-*a;*

FIGS. 2-*a* and 3-*a* are views schematically showing the corona transfer method in accordance with this invention;

FIGS. 2-*b* and 3-*b* are enlarged views of a part of FIGS. 2-*a* and 3-*a* respectively;

Figure 4:
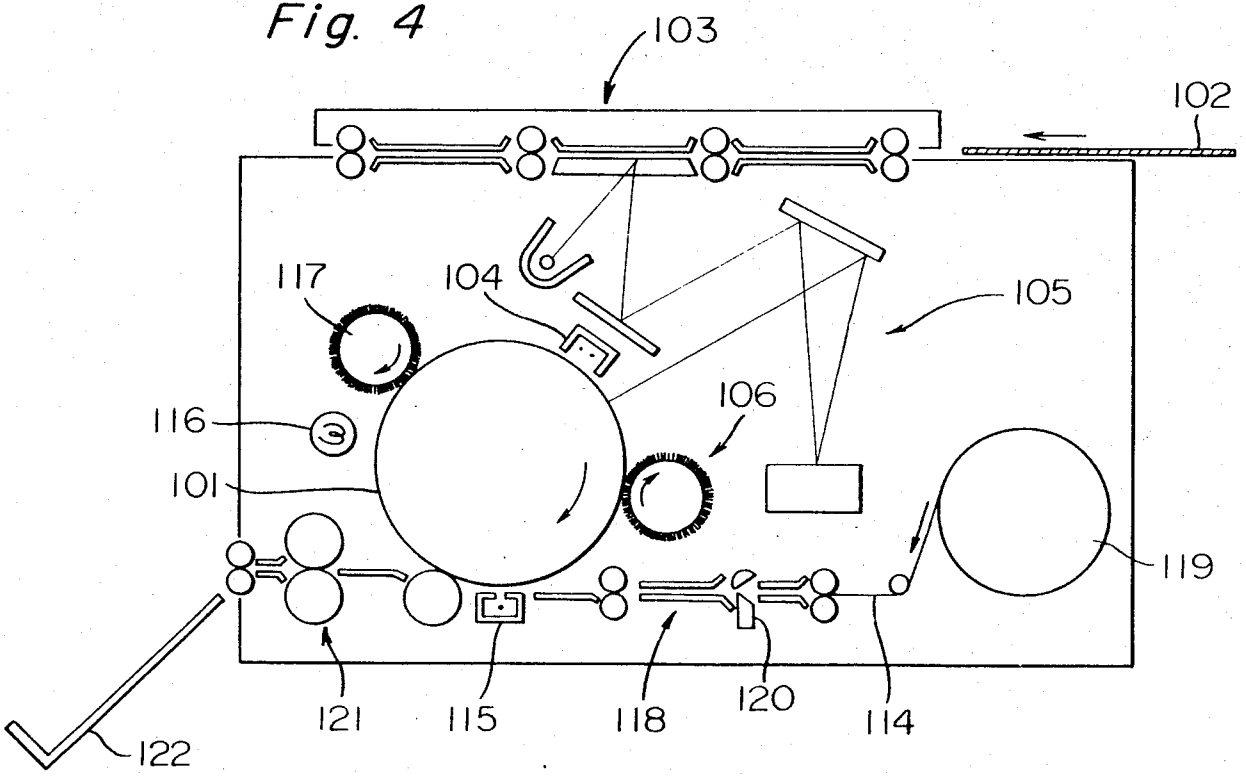
FIG. 4 is a simplified view of an electrostatographic apparatus.

FIG. 1-*a* schematically shows the conventional corona transfer method. In a corona transfer method which comprises transferring a toner image 8 formed by a method known to those skilled in the art on the surface of an imaging member 2 composed, for example, of a material having a photoconductive layer 4 and a conductive layer 6 to the surface of a receptor member 10 such as a sheet of paper, the surface of the image-bearing member 2 having the toner image 8 is contacted with the surface of the receptor member 10, and corona discharge is applied to the back surface of the receptor member 10 by means of a corona discharge device 12. The corona discharge device 12 includes a discharge electrode 14 made of a fine metallic wire and a shield case 16. If in such a transfer method, the toner image 4 is the one obtained by development with a two-component developer consisting of a magnetic carrier and a non-conductive toner material, a transferred image of good quality can be obtained by simply applying corona discharge having an opposite polarity to the toner material. This is because the toner material of the toner image 8 has high resistance and a charge of a definite polarity, and no great care is required in applying corona discharge. However, when the toner image 8 is the one developed with a one-component developer consisting only of a conductive or semiconductive toner material, and therefore, the toner material of the toner image 8 is a conductive or semiconductive, the conventional corona transfer methods can only afford transferred images of markedly unclear contours because of the scattering of the toner material during transfer.

As a result of extensive investigations and experiments, the present inventors have found that the following are causes of the scattering of the toner material during transfer.

In a corona discharge device 12 illustrated in FIG. 1-*a,* a nearly concentric distribution of electric field intensity is formed about a discharge electrode 14 as shown by line A, and therefore, lines of electric force of a corona discharge from the discharge electrode 14 which cross the field intensity distribution shown by line A disperse approximately radially from the discharge electrode 14. In such a case, the lines of electric force are inclined by a considerably large angle $\alpha$ in FIG. 1-*b,* $\alpha$ is approximately 50 degrees) with respect to a line perpendicular to receptor member 10, especially near both side edge portions of shield case 16, as clearly shown in FIG. 1-*b.* On the other hand, when the toner material of the toner image 8 is conductive or semicondutive, the toner material undergoes a force acting in the direction of the lines of electric force by the corona discharge applied to the back surface of the receptor member 10, and is thus moved in that direction. Accordingly, particularly in the vicinity of both side edges of the shield case 16, the toner material of the toner image 8 scatters between the surface of the image-bearing member 2 and the surface of the receptor member 10 by being moved in a direction considerably inclined to the receptor member 10.

With this background, the present inventors have found that in order to prevent the scattering of the toner material during transfer, it is important that the lines of electric force of the corona discharge applied to the back surface of the receptor member 10 from the corona discharge device 12 should not be inclined by more than about 30 degrees, especially by more than about 20 degrees, with respect to a line perpendicular to the receptor member 10.

In order to achieve this angular limitation, a corona discharge device 22 illustrated in FIG. 2-*a* or a corona discharge device 32 illustrated in FIG. 3-*a* can, for example, be used with good results instead of the ordinary corona discharge device 12 shown in FIG. 1-*a.*

In the corona discharge device 22 illustrated in FIG. 2-*a,* shield case 26 has an extension 26*a* at both of its lower ends which extends inwardly over a considerably large distance. It is important that the extension 26*a* should fully extend such that the angle $\beta$ formed between a line connecting the inward end of the extension 26*a* to discharge electrode 24 and a line perpendicular to the receptor member 10 does not exceed about 30 degrees, especially about 20 degrees. (in FIG. 2-*a,* the angle $\beta$ is about 19°).

In such a corona discharge device 22, the field intensity distribution A about the discharge electrode 24 is deformed at the opening portion of the shield case, as shown in FIG. 2-*a.* The lines of electric force of corona discharge from the discharge electrode 24 assume the form illustrated by broken line B in FIG. 2-*a.* Consequently, those lines of electric force of the corona discharge from the discharge electrode 24 which pass through the opening portion of the shield case 26 and reach the receptor member 10 are not inclined greatly to the line perpendicular to the receptor member 10, but become approximately perpendicular to the receptor member 10. In the corona discharge device 22 illustrated in FIG. 2-*a,* the maximum angle $\alpha$ formed between the lines of electric force of the corona discharge reaching the back surface of the receptor member 10 and the line perpendicular to the receptor member does not exceed 30 degrees, as shown in FIG. 2-*b* (in FIG. 2-*b,* the maximum angle $\alpha$ is about 19 degrees).

Thus, when the lines of electric force of the corona discharge reaching the back surface of the receptor member 10 are approximately perpendicular to the receptor member 10, the force which acts on the conductive or semiconductive toner material transferred from the surface of the image-bearing member 2 to the surface of the receptor member 10 is approximately perpendicular to the receptor member 10, and therefore, the toner is not moved between the surface of the image-bearing member 2 and the surface of the receptor member 10 in a direction parallel to these surfaces. Accordingly, the toner material does not scatter during transfer, and it is possible to obtain on the receptor member 10 a transferred image having substantially same clearness and sharpness as the toner image formed on the imaging member 2.

The corona discharge device 32 shown in FIG. 3-*a* is made up of a metallic ribbon-like discharge electrode 34, and a shield case 36 having a shape conforming to the electrode 34 (generally rectangular-shaped with the distance between the two side walls being relatively small). Preferably the ribbon-like discharge electrode 34 has a sharp knife edge at at least its lower edge, especially at both of its lower and upper edges. Conveniently, the ribbon-like corona discharge electrode is made of a metal foil having a thickness of about 20 to 100 microns, preferably 30 to 50 microns, and a width of 1 to 7 mm, preferably 2 to 5 mm. The metal may be any metals previously used to make corona discharge electrodes, and our experiments gave good results with tungsten, molybdenum, and stainless steel. The sharp knife edge can be obtained by working the edges of the metal foil by methods known to those skilled in the art. The most common method of obtaining such knife-like edges involves immersing a ribbon-like electrode in, for example, an aqueous solution of sodium hydroxide, and passing an electric current between the ribbon-like electrode as one electrode and a carbon rod or a stainless steel plate, for example, as the other thereby to etch the edge of the ribbon-like metal by electrolysis. The method of producing such a knife-like edge is described in detail, for example, in Japanese Patent Publications Nos. 8563/61, 12755/61, 14562/66, and 8536/56.

In this corona discharge device 32, the distribution of electric field intensity distribution about the discharge electrode 34 assumes the form shown by line A in FIG. 3-*a*. Corona discharge is generated concentratingly from the sharp knife edge of the discharge electrode 34, and assumes the form shown by broken line B in FIG. 3-*b*. Those lines of electric force of the corona discharge from the electrode 34 which pass through the opening portion of the shield case 36 and reach the back surface of the receptor member 10 become approximately perpendicular to the receptor member 10. Consequently, as shown in FIG. 3-*b*, the maximum angle $\beta$ formed between the lines of electric force of the corona discharge reaching the back surface of the receptor member 10 and the line perpendicular to the receptor member 10 does not exceed 30 degrees (in FIG. 3-*b*, the maximum angle $\alpha$ is about 18 degrees).

As regards the polarity of corona discharge voltage at the time of transfer of such conductive or semiconductive toner, Japanese Laid-Open Patent Publication No. 117435/75 discloses that it is preferred to apply a voltage having a polarity which is opposite to the polarity of the transfer voltage used at the time of transfer of a toner image developed with a two-component developer containing a relatively high resistant toner material charged to a definite polarity, namely, opposite to the polarity of the electrostatic latent image. According to this concept, if the charge forming the electrostatic latent image is negative, a polarized electric charge occurs easily inside the toner material, because the toner material is conductive. As a result, a negative electric charge of the same polarity as the charge of the electrostatic latent image is generated on that side of the toner material with which the receptor member will make contact. Accordingly, the toner material can be transferred by applying a positive voltage to the receptor material.

We believe however that it is appropriate to apply a voltage which is of the same polarity as in the case of transferring a toner image developed with a toner material which has a relatively high resistance and polarity. The mechanism of transfer, however, is different from that of conventional toners having polarity. The electric charge of the electrostatic latent image induces a polarized charge inside, and a negative charge is present on that side of the toner material which will make contact with the receptor member and a positive charge is present on that side which faces the electrostatic image charge. This polarization of electric charges responds to changes in an external electric field more rapidly as the toner material has higher conductivity. Accordingly, when a transfer voltage of negative polarity is applied from the back surface of the receptor member, the direction of polarization inside the toner easily reverses, whereupon a positive charge is generated on the receptor side and a negative charge on the electrostatic image side. As a result of this reversal of polarization, the toner material undergoes strong repulsion from the electrostatic latent image, and simultaneously, attraction to the receptor member side. Hence, transfer can be achieved with good efficiency.

The present inventors have also found that the shape of the toner particles has some influence on the scattering of the toner material during transfer.

Those skilled in the art know nearly spherical toner particles prepared by a method disclosed, for example, in U.S. Pat. No. 3,093,039 irregularly shaped toner particles having a plurality of angular portions which are prepared by a method disclosed, for example, in U.S. Pat. No. 3,345,294 as the conductive or semiconductive toner material. The present inventors have found that to prevent the scattering of the toner during transfer the irregularly shaped toner particles are preferred to the spherical ones. The relative ease of scattering of the spherical toner particles is probably because with the spherical particles, the charge induced inside the toner material by the electrostatic latent image is distributed uniformly on the surface of the toner material. On the other hand, with the irregularly shaped toner particles, an electric charge is concentrated on the angular portions, and therefore, the moving direction of the toner material during transfer can be definitely set. This appears to be the reason why good results can be obtained with irregularly shaped toner particles.

Furthermore, the present inventors mixed in a mixer irregularly shaped toner particles (prepared by the method of U.S. Pat. No. 3,345,294) to round the angular portions of these particles and to form approximately ellipsoidal toner particles, and performed experiments using the resulting toner particles. It was consequently found that when the ellipsoidal toner particles are used, their scattering during transfer is restrained in substantially the same manner as in the case of using the irregularly shaped toner particles.

In regard to scattering during transfer, the irregularly shaped toner particles and the ellipsoidal toner particles give substantially the same results. However, the ellipsoidal toner particles have better flowability than the irregularly shaped ones, and therefore have less tendency to agglomeration than the latter in the step of developing an electrostatic latent image.

One example of electrostatographic apparatus to which the transfer method of this invention has been applied is described below with reference to FIG. 4.

The apparatus shown includes a photosensitive drum 101 equipped, for example, with a conductive base plate and a photoconductive layer formed on its surface, and adapted to be rotated in the direction of arrows. At the top of the apparatus, an original-transfer mechanism 103 is provided which transfers an original 102 to be copied at the same speed as the peripheral speed of the photosensitive drum 101.

An electrostatic latent image-forming zone, a developing zone, a transfer zone, etc, are disposed along the periphery of the photosensitive drum. The electrostatic latent image-forming zone includes a charging device 104 for charging the surface of the photosensitive drum to a definite polarity. Preferably, this charging device 104 is one which can charge the surface of the photosensitive drum to 100 to 600 V, preferably about 300 V. It can, for example, be made of a corona discharge device having a direct current high voltage source of 4 to 8 KV. An optical system generally shown by numeral 105 projects an image of the original 102 onto the surface of the photosensitive drum charged to a definite polarity, and thus forms an electrostatic latent image corresponding to the original 102 of the drum surface.

Figure 5:
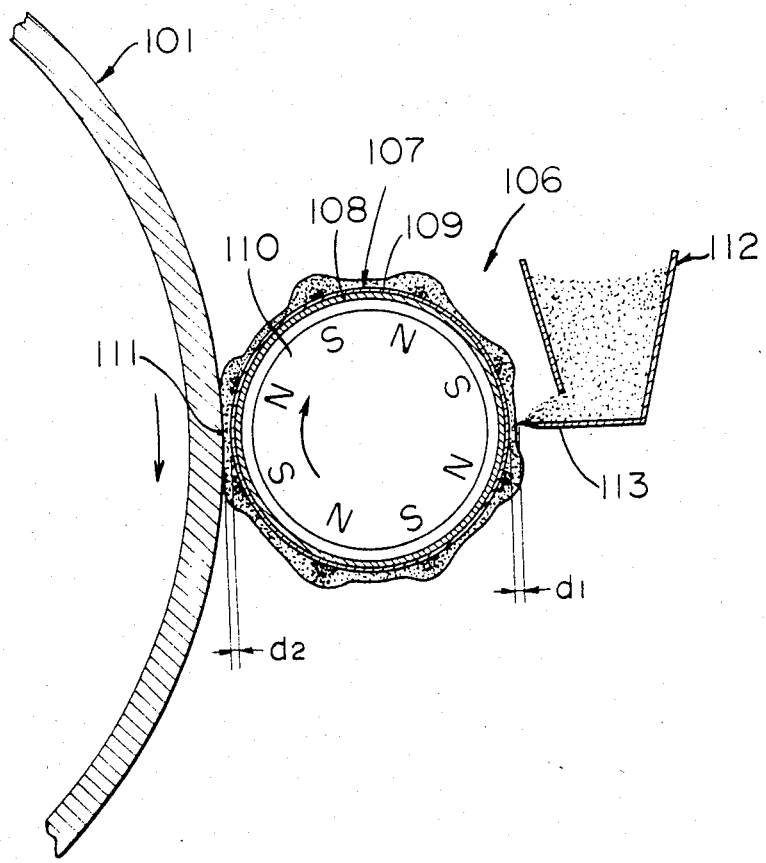
FIG. 5 is an enlarged view showing the details of a developing device used in the electrostatographic apparatus shown in FIG. 4.

The developing zone includes a developing device 106 for developing the electrostatic latent image by applying a conductive or semiconductive toner material thereto. Referring to FIG. 5, the developing device 106 will be described in detail. The developing device 106 is made up of a main body 108 of a non-magnetic metal material such as aluminum and a surface coating 109 of an insulating material formed on the surface of the main body 108, such as aluminum oxide obtained by oxidizing the surface of the main body 108, and includes a developer-retaining member 107 rotatable in a direction opposite to the rotating direction of the photosensitive drum. Within the developer-retaining member 107, there is fixed, for example, a permanent magnet 110 having eight magnetic poles which are alternately of opposite polarities along its periphery. As shown, the permanent magnet 110 is disposed preferably in such a position that a point 111 at which the surface of the photosensitive drum and the surface of the developer-retaining member approach each other most closely is situated between two magnetic poles. The developing device 106 further includes a developer container 112 for feeding the conductive or semiconductive toner to the surface of the developer-retaining member. The tip of a flat plate member 113 which forms the bottom wall of the developer container 112 extends to a position in proximity to the surface of the developer-retaining member, and thus forms a member for adjusting the thickness of the toner layer to be retained on the developer-retaining member. Preferably, the distance $d_1$ between the forward end of the flat plate member 113 and the surface of the developer-retaining member 107 is 0.2 to 1.0 mm, especially 0.35 to 0.6 mm. On the other hand, the distance $d_2$ between the surface of the developer-retaining member and the surface of the photosensitive drum at the point at which both approach each other most closely is preferably equal to, or somewhat smaller, than $d_1$.

The transfer zone includes a corona discharge device 115, similar to the corona discharge device 22 illustrated in FIG. 2-*a*, for applying a corona discharge to the back surface of a receptor sheet 114 whose front surface is in contact with a toner image formed on the surface of the photosensitive drum. The corona discharge device 115 can transfer the toner image obtained by development with a conductive or semiconductive toner material to the receptor sheet 114 in good condition.

A light source 116 for irradiating light to the surface of the photosensitive drum and thus removing the charge on the surface of the photosensitive drum is provided downstream of the transfer zone when viewed in the rotating direction of the photosensitive drum. A cleaning device 117 is provided downstream of the light source 116 for removing the toner material remaining on the surface of the photosensitive drum. When the toner material is to be fixed by pressing, the cleaning device 117 preferably includes a rotatable sleeve member and a stationary permanent magnet which is disposed within the sleeve member and magnetically attracts the toner material remaining on the drum surface to the surface of the sleeve member. This is because the use of a cleaning device made of a conventional fur brush or blade and applying pressure and/or heat to the toner material is likely to cause the toner material to be fixed to the drum surface.

The electrostatographic apparatus further includes a receptor sheet feeding mechanism 118 which conveys the receptor sheet 114 to the transfer zone synchronously with the rotation of the photosensitive drum. In the specific embodiment shown in the drawings, the receptor sheet feeding mechanism 118 includes an ordinary cutting device 120 for cutting the receptor sheet pulled out from a receptor sheet roll 119 to a suitable length corresponding to the length of the original 102. The receptor sheet pulled out from the roll 119 and cut to a suitable length is transferred to the transfer zone by a known means such as transfer rolls, and there, makes contact with the toner image formed on the surface of the photosensitive drum. Simultaneously, it undergoes the action of the corona discharge device 115, and thus, the toner image formed on the drum surface is transferred to the receptor sheet. The receptor sheet having the toner image transferred thereto in this manner is then discharged into a tray 122 through a fixing device 121 for fixing the toner image on the receptor sheet by pressure or heat.

The developing process and the transfer process using a developer consisting of a conductive or semiconductive toner material as described above can be conveniently applied also to "electrostatic printing". Generally, the electrostatic printing process involves an operation comprising forming a permanent image of a toner material on the surface of an electrofax sensitive sheet coated, for example, with a dispersion of zinc oxide and a resin by a process of charging/original image exposure/development/fixation, thereby to form an electrostatic printing master; uniformly charging the surface of the resulting master; and then irradiating light uniformly on the master surface. As a result of this operation, the charge remains on the toner material forming the permanent image in the permanent image-bearing area of the master surface, and on the other hand, the charge dissipates at the non-image area. Accordingly, an electrostatic image corresponding to the original image is formed on the surface of the master. A copy of the original image can be obtained by developing this electrostatic latent image with a toner material and then transferring the toner image to a suitable receptor sheet. Since the permanent image of the toner is formed on the surface of the master, a number of copies can be obtained rapidly by repeating uniform charging, uniform light irradiation, development and transfer. Thus, the above-described developing process and transfer process using a developer consisting of a conductive or semiconductive toner material can be conveniently applied to the development and transferring of an electrostatic latent image formed in the above manner by the electrostatic printing process involving uniform charging of the master surface and uniform irradiation of light thereto.

Not only the zinc oxide resin dispersed type photosensitive sheet as mentioned above, but also what is generally called chemographic sheets can be used as the photosensitive sheet for preparing masters in electrostatic printing. In the latter case, the resistance of the light irradiated area of the master surface changes as a result of original image exposure at the time of master preparation, and this change continues. Hence, a master can be prepared by merely exposing the original image without the need to form a permanent image by developing the exposed image with a toner material and fixing the toner image.

In the electrostatic printing method in which a master is formed by using the zinc oxide sensitive paper, a toner material of relatively high resistance can be conveniently used for forming the permanent image. The degree of the resistance is, for example, such that when the surface of the permanent image is uniformly charged, the surface potential and the degree of potential decay of the image area are substantially equal to those of the non-image area. A transparent toner material could be used for forming the permanent image, but it is desirable to use a white or black toner so that it reflects or absorbs light in uniform light exposure after uniform charging and thus prevents it from reaching the sensitive surface.

Some of the conductive or semiconductive toner material used for developing the electrostatic latent image formed on the surface of the master remains on the master surface after the transfer of the toner image. When printing is repeated without removing the remaining toner material, the charging characteristics of the permanent image-bearing area of the master surface gradually changes because of the conductivity or semiconductivity of the toner material. This gradually leads to the formation of printed images having degraded quality. Desirably, therefore, the toner material remaining in the permanent image-bearing area is fully cleaned prior to a printing step after transfer.

EXAMPLE 1

Receptor sheets having toner images transferred thereto were obtained by using an electrostatographic apparatus illustrated in FIG. 4.

As a charging device 104 in the electrostatic latent image-forming zone, an ordinary corotron-type charging device having two discharge electrodes made of a fine metallic wire was used. A direct current voltage of about +5.4 KV was applied to the two discharge electrodes to charge the surface of the photosensitive drum to about +600 V.

In the developing device in the developing zone, a developer composed only of toner particles being approximately spherical and having an average particle diameter of 15 microns and a volume resistivity of about $5\times10^9$ ohms.cm was applied to the electrostatic latent image formed on the surface of the photosensitive drum to develop the latent image.

Figure 7:
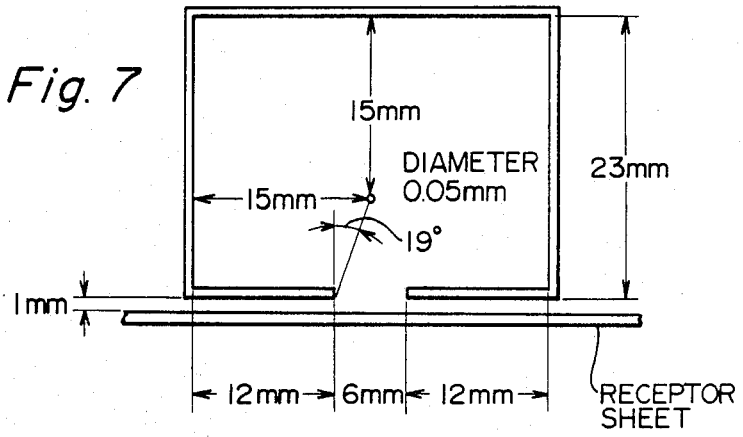

As corona discharge device 115 in the transfer zone, a device having the configuration and dimension shown in FIG. 7 was used, and a direct current voltage of about +6 KV was applied to the discharge electrode.

Bond paper, art paper, and low-grade paper having a chemical pulp content of less than 70% were used as receptor sheets. Bond paper had a stiffness of about 3 cm; art paper, about 3.5 cm; and the low-grade paper, about 4.5 cm. The stiffness of paper is defined as the length of one free end of a square-shaped sample of paper with an area of $10\times10$ cm$^2$ which sags by the effect of gravity while the other end is fixed. The smoothness of the surface of bond paper was about 38 mmHg; that of art paper, about 9 mmHg; and that of the low-grade paper, about 60 mmHg. The smoothness of paper was measured by a smoothness tester using mercury (SMOOSTR, a trademark for a product of Toei Denshi Kogyo K.K., Japan). the thickness was 80 microns for bond paper; 70 microns for art paper; and 85 microns for the low-grade paper.

The moving speed of the surface of the photosensitive drum and the moving speed of the receptor sheet were both 11 meters/min.

As a result, the contour of letters and lines in the toner image transferred to the low-grade paper had a somewhat low degree of sharpness. But the toner images transferred to the bond paper and art paper showed a high degree of sharpness in the contour of letters and lines.

The density of the lines in each of the toner images transferred to receptor sheet (these lines in the original had a width of 1 mm and a density of 1.3) in a direction crossing the lines was measured by using a measuring device having a measuring slit of 0.5 mm$\times$0.025 mm (SAKURA MICRO DENSITOMETER PDM-5, a trademark for a product of Konishiroku Photo Ind. Co., Ltd.). The results are shown in solid lines in FIG. 9 (in the case of using the bond paper), FIG. 10 (in the case of using the art paper), and FIG. 11 (in the case of using the low-grade paper).

COMPARATIVE EXAMPLE 1

Figure 6:
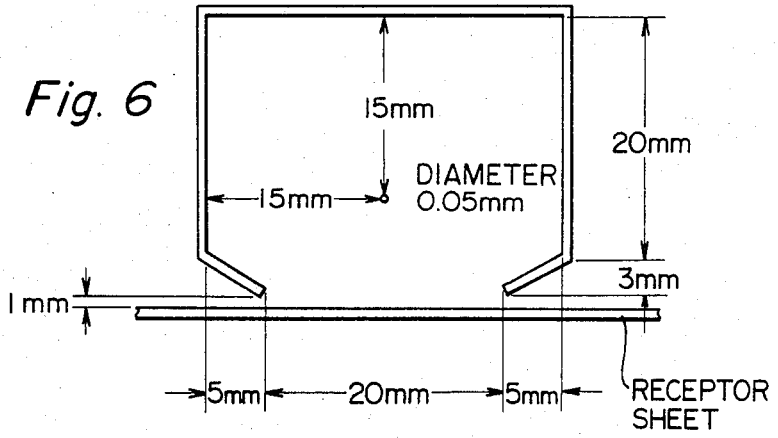
FIGS. 6 to 8 are views showing the corona discharge devices used in Example 1, Comparative Example 1 and Example 2 to be given hereinbelow.

Toner images transferred to receptor sheets were obtained under the same conditions as in Example 1 except that a device having the configuration and dimension shown in FIG. 6 was used as the corona discharge device in the transfer zone.

The toner images transferred to the bond paper, art paper and low-grade paper were all inferior in the sharpness of the contour of letters and lines to the toner images obtained in Example 1.

The densities of the lines of the resulting toner images which correspond to the lines measured in Example 1 were measured by the same method as used in Example 1. The results are shown in broken lines in FIG. 9 (in the case of using the bond paper), FIG. 10 (in the case of using the art paper), and FIG. 11 (in the case of using the low-grade paper).

Figures 9, 10, 11:
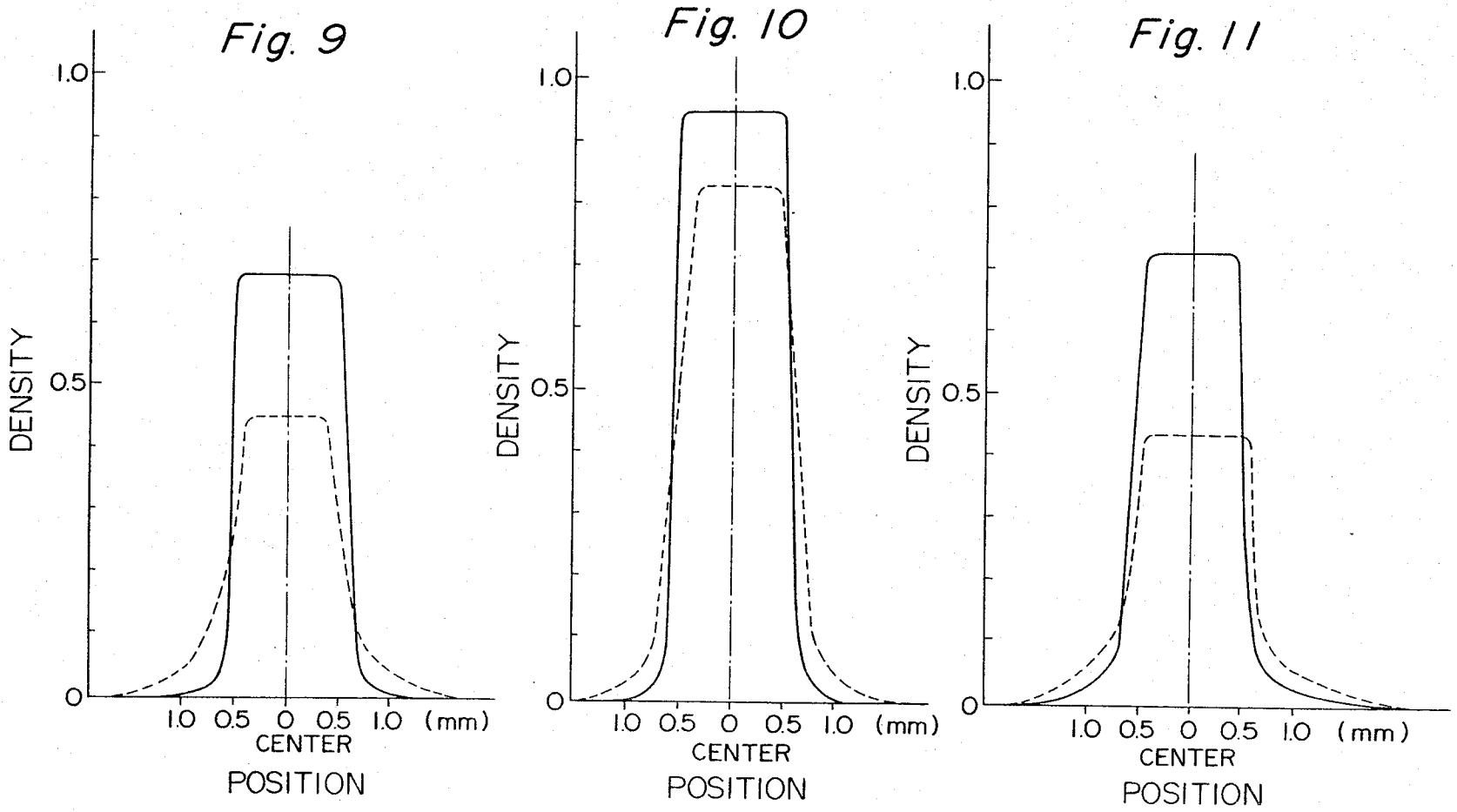
FIGS. 9 to 11 are diagrams showing the densities of the toner images transferred to receptor sheets which were obtained in Example 1 and Comparative Example 1.

It will be readily appreciated from a comparison of the solid lines with the broken lines in FIGS. 9 to 11 that according to the transfer method of this invention, the scattering of the toner material during transfer can be substantially prevented, and toner images having a sharp contour of letters and lines can be obtained on receptor sheets.

EXAMPLE 2

Figure 8:
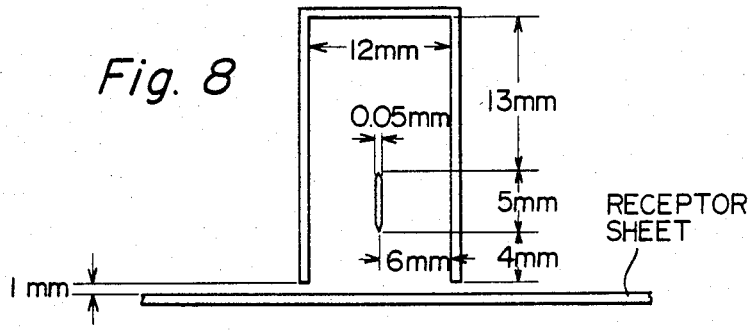

Toner images transferred to receptor sheets were obtained under the same conditions as in Example 1 except that a device having the configuration and dimension shown in FIG. 8 was used as the corona discharge device in the transfer zone, and a direct current voltage of about +7 Kg was applied.

The resulting toner images were substantially the same in quality as those obtained in Example 1.

EXAMPLE 3

Toner images transferred to receptor sheets were obtained under the same conditions as in Example 1 except that in the developing device in the developing zone, a developer composed only of toner particles which were irregularly shaped with a plurality of angular portions, and had an average particle diameter of about 15 microns and a volume resistivity of about $8\times10^9$ ohms.cm was used.

The sharpness of the contour of letters and lines in the resulting toner images was somewhat higher than that of the toner images obtained in Example 1.

EXAMPLE 4

Toner images transferred to receptor sheets were obtained under the same conditions as in Example 1 except that in the developing device in the developing zone, a developer composed only of toner particles which were ellipsoidal in shape and had an average particle diameter of about 15 microns and a volume resistivity of about $7\times10^9$ ohms.cm was used.

The resulting toner images were substantially the same in quality as those obtained in Example 3.

What we claim is:

1. A method for transferring a toner image on the surface of an image-bearing member comprising the steps of developing with a conductive or semiconductive toner material a latent electrostatic image on the surface of the image-bearing member to form a conductive or semiconductive toner image, bringing the surface of a receptor member into contact with the toner image on the surface of the image-bearing member and simultaneously applying a corona discharge to the back surface of the receptor member; wherein the angle formed between the lines of electric force of the corona discharge and a line perpendicular to the receptor member does not exceed about 30 degrees, whereby scattering of the conductive or semi-conductive toner material is prevented and a high quality transfer image having a sharp contour is provided on the surface of the receptor member.

2. The method of claim 1 wherein the said angle does not exceed about 20 degrees.

3. The method of claim 1 or 2 wherein the corona discharge is applied by a corona discharge device having a discharge electrode made of a thin metallic wire and a shield case having an inwardly projecting extension at its both lower ends.

4. The method of claim 1 or 2 wherein the corona discharge is applied by a corona discharge device having a ribbon-like discharge electrode.

5. The method of claims 1 or 2 wherein the toner material consists of irregularly shaped toner particles having a plurality of angular portions.

6. The method of claims 1 or 2 wherein the toner material consists of ellipsoidal toner particles.

7. A method for transferring a toner image on the surface of an image-bearing member comprising the steps of developing with a one component conductive or semi-conductive toner material an electrostatic latent image on the surface of the image-bearing member to form a conductive or semi-conductive toner image, bringing the surface of a receptor member into contact with the toner image on the surface of the image-bearing member and simultaneously applying a corona discharge to the back surface of the receptor member by means such that the angle formed between the lines of the electric force of the corona discharge and a line perpendicular to the surface of the receptor member is less than about 30°, whereby scattering of the conductive or semiconductive toner material is prevented and a high quality transfer image having a sharp contour is provided on the surface of the receptor member.

8. The method of claim 7 wherein an angle formed between the lines of electric force of the corona discharge and a line perpendicular to the receptor member is less than 20°.

9. The method of claim 7 wherein the corona discharge voltage is of the same polarity as the electrostatic charge of the latent image.

10. The method of claim 1 wherein said one component conductive or semiconductive toner material has a volume resistivity of at least $5\times10^9$ ohms.

* * * * *